US006371602B1

(12) United States Patent
Asano

(10) Patent No.: US 6,371,602 B1
(45) Date of Patent: Apr. 16, 2002

(54) INK-JET RECORDING HEAD, AND PROCESS FOR FORMING INK-JET RECORDING HEAD

(75) Inventor: Takeshi Asano, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 08/946,660

(22) Filed: Oct. 7, 1997

(30) Foreign Application Priority Data

Oct. 7, 1996 (JP) ..... 8-266239

(51) Int. Cl.[7] ..... B41J 2/045
(52) U.S. Cl. ..... 347/71
(58) Field of Search ..... 347/68–71; 310/328

(56) References Cited

U.S. PATENT DOCUMENTS 4,584,590 A * 4/1986 Fischbeck et al. ..... 347/69
4,730,197 A * 3/1988 Raman et al. ..... 347/70
4,825,227 A * 4/1989 Fischbeck et al. ..... 347/69
5,327,627 A * 7/1994 Ochiai et al. ..... 347/71
5,512,793 A * 4/1996 Takeuchi et al. ..... 310/328
5,825,121 A * 10/1998 Shimada ..... 310/358

FOREIGN PATENT DOCUMENTS

JP 406166179 * 6/1994 ..... 347/69

* cited by examiner

*Primary Examiner*—John Barlow
*Assistant Examiner*—Michael S Brooke
(74) *Attorney, Agent, or Firm*—Oliff & Berridge, PLC

(57) ABSTRACT

An ink-jet recording head comprises a plate member in which a plurality of pressure chambers partitioned with sidewalls are formed in the form of grooves and one side of which is caused to vibrate by a piezoelectric device to thereby control the pressure of an ink held in the pressure chambers and eject the ink from nozzles communicating with the pressure chambers. A sheet type piezoelectric device provided with electrodes and having been polarized is laminated to the plate member on the side opposite to the pressure chambers-formed side.

25 Claims, 10 Drawing Sheets

INK-JET RECORDING HEAD, AND PROCESS FOR FORMING INK-JET RECORDING HEAD

BACKGROUND OF THE INVENTION

1. Field of the Invention

This invention relates to an ink-jet recording head and a process for its formation; the ink-jet recording head being an ink-jet recording head comprising a plate member in which a plurality of pressure chambers partitioned with sidewalls are formed in the form of grooves and one side surface of which is caused to vibrate by a piezoelectric device to thereby control the pressure of an ink held in the pressure chambers and eject the ink from nozzles communicating with the pressure chambers.

2. Description of the Related Art

In conventional ink-jet recording heads, as shown in FIG. 10A, to a cavity plate 103 on one side surface of which pressure chambers (cavities) 101 are formed in the form of grooves, a plate material 105 is joined with an adhesive or the like on the one side surface where the pressure chambers open, to close the pressure chambers 101, and vibrating plates 107 and piezoelectric devices 109 are arranged on the plate material 105. Then, a drive voltage is applied to electrodes 111 and 113 provided to the piezoelectric devices 109, to thereby cause the piezoelectric devices 109 to deform and, concurrently therewith, the plate material 105 closing the pressure chambers 101 to deform, so that the pressure of ink in the pressure chambers 101 can be controlled to eject the ink outward from nozzles communicating with the pressure chambers 101.

In such a ink-jet recording head, usually a plurality of pressure chambers 101 are provided and the ink is ejected from the nozzles communicating with the pressure chambers 101, where it is important from the viewpoint of print quality that their ejection performance is uniform.

Now, the pressure chambers 101 are closed by joining the plate material 105 to the cavity plate 103 at the top edge faces 117 of the sidewalls that partition the pressure chambers 101. Thus, originally independent materials are joined to each other in respect of the cavity plate 103 forming the pressure chambers 101 and the plate material 105 deformed by the piezoelectric devices 109. Hence, the state of joining between them is greatly concerned with the deformation properties of the plate material 105, and the uniformity of accuracy at the joints affects the uniformity of ejection performance of the nozzles.

In order to uniform the accuracy at the joints, the top edge faces 117 of the sidewalls 115 and the plate material 105 side are required to have a high flatness. They are also required to be uniformly joined at the joints when joined with an adhesive or the like.

However, it is difficult to achieve a high flatness and uniform joining at the all joints, and any slightly non-uniform flatness or joining may cause a delicate change in the deformation properties of the plate material 105, vibrating plates 107 and piezoelectric devices 109 which are supported at the top edge faces 117 of the sidewalls 115, making it difficult to impart uniform ejection performance to all nozzles.

As also shown in FIG. 10B, in order to double resolution, one may have an idea that pressure chambers 201 are formed on both sides of a cavity plate 203 in a alternately half-pitch shifted state, and laminates of piezoelectric devices 209 and vibrating plates 207, respectively formed on plate materials 205, are joined in such a way that their positions are in agreement with the positions of the open areas of the pressure chambers 201, and thus the nozzles can be provided in a higher density. Since, however, the above problem also arises on the both sides, the problem of the non-uniformity in flatness and joining becomes more serious, bringing about the problem that it is difficult to make the nozzle density higher.

SUMMARY OF THE INVENTION

An object of the present invention is to provide an ink-jet recording head that can prevent the deformation properties of plate materials, cavity plates and piezoelectric devices from being affected by the non-uniform flatness and joining for each sidewall and can impart uniform ejection performance to all nozzles, and a process for forming such an ink-jet recording head.

To achieve the above object, the present invention provides an ink-jet recording head comprising a plate member in which a plurality of pressure chambers partitioned with sidewalls are formed in the form of grooves and one side of which is caused to vibrate by a piezoelectric device to thereby control the pressure of an ink held in the pressure chambers and eject the ink from nozzles communicating with the pressure chambers; wherein a sheet type piezoelectric device provided with electrodes and having been polarized is laminated to the plate member on the side opposite to the pressure chambers-formed side.

The present invention also provides a process for forming the ink-jet recording head as above; the process comprising the steps of;

forming an electrode on the surface of an unbaked sheet type piezoelectric device;

joining the sheet type piezoelectric device to the plate member on its one side, made of a material having a nature similar or identical to the sheet type piezoelectric device, to form a laminate;

baking the laminate, and after the baking;

forming pressure chambers in the form of grooves on the surface of the laminate on the plate member side;

covering the pressure chambers with a sheet-like cover member; and before or after the covering with the sheet-like cover member, subjecting the sheet type piezoelectric device to polarization.

This and other objects, features and advantages of the present invention are described in or will become apparent from the following description.

In the ink-jet recording head of the present invention, a sheet type piezoelectric device provided with electrodes and having been polarized is laminated to the plate member on the side opposite to the pressure chambers-formed side. More specifically, the sheet type piezoelectric device is laminated to the plate member not on the open side of the pressure chambers but on its external surface on the side opposite thereto. This lamination can be achieved by, e.g., a method in which the sheet type piezoelectric device is joined with an adhesive to a plate member in which grooves for the pressure chambers have been made, or a method in which an unbaked sheet type piezoelectric device and an unbaked plate member with the grooves are brought into close contact by vacuum pressing or the like followed by baking to form the pressure chambers.

Accordingly, since the sheet type piezoelectric device is not joined on the open side of the pressure chambers of the plate member, it follows that the device is not joined to the top edge faces of the sidewalls partitioning the pressure chambers and is laminated to the external surface on the opposite-side continuous single surface of the plate member. Thus, for both the sheet type piezoelectric device side and the plate member side, the uniformity concerning flatness and joining may be achieved on the single surface, so that a lamination that is uniform over the all pressure chambers can be achieved with ease and hence an ejection performance that is uniform over the all nozzles can be attained.

The other side of the plate member, the open side of the pressure chambers, may be covered with a sheet-like cover member. Even if this sheet-like cover member is joined a little non-uniformly, there can not be any effect that may come into question on the ejection performance, because any deformation does not take place on the side of the sheet-like cover member.

As the direction of polarization, the sheet type piezoelectric device may be polarized, e.g., in its thickness direction. In this instance, the electrodes may be so disposed that the direction of electric fields is identical with or reverse to the direction of polarization, i.e., in what is called the unimorph type formation. For example, the electrodes may be so disposed that they are formed on both sides of the sheet type piezoelectric device, where,,of the electrodes, ones on the side of which the piezoelectric device is laminated to the plate member or on the side opposite thereto are provided for each pressure chamber. An electrode on the side opposite to the electrodes provided for each pressure chamber may be formed as an electrode common to the all pressure chambers.

Upon application of a drive voltage to such electrodes, when, e.g., the electric fields and polarization are in the same direction, the sheet type piezoelectric device held between the electrodes partly shrinks in the direction perpendicular to the direction of polarization. Here, the plate member standing laminated to the sheet type piezoelectric device does not shrink, and hence the sheet type piezoelectric device and the plate member partly bend to become convex on the plate member side, i.e., on the side of a pressure chamber. This causes a decrease in volume of the pressure chamber to cause an increase in pressure of the ink, so that the ink is ejected from the corresponding nozzle. Once the application of the drive voltage is stopped, the bent portion of the sheet type piezoelectric device and plate member returns to the original state and the volume of the pressure chamber returns to the original volume, so that the ink is sucked therein from the feeding side.

On the other hand, when, e.g.,. the electric fields and polarization are in reverse direction, the sheet type piezoelectric device held between the electrodes partly extends in the direction perpendicular to the direction of polarization. Here, the plate member standing laminated to the sheet type piezoelectric device does not extend, and hence the sheet type piezoelectric device and the plate member partly bend to become concave on the plate member side, i.e., on the side of a pressure chamber. This causes an increase in volume of the pressure chamber, so that the ink is sucked therein from the feeding side. Once the application of the drive voltage is stopped, the extended portion of the sheet type piezoelectric device and plate member returns to the original state and the volume of the pressure chamber returns to the original volume, so that the ink is ejected from the corresponding nozzle. In this way, these can function as an ink-jet recording head.

The electrodes may also be so disposed that the direction of electric fields and the direction of polarization cross each other, i.e., in what is called the shearing mode type formation. They may cross, e.g., at right angles or at substantially right angles. In this instance, the electrodes may be so disposed that they are formed on one side or both sides of the sheet type piezoelectric device, and they are respectively provided at the positions corresponding to the pressure chambers and at the positions corresponding to the boundaries between adjoining pressure chambers.

Upon application of a drive voltage to such electrodes, the sheet type piezoelectric device held between the electrodes partly undergoes thickness slippage to deform. In accordance with this deformation, the plate member partly deforms to become convex or concave on the side of a pressure chamber. This causes a change in volume of the pressure chamber, so that the ink is ejected from the corresponding nozzle or sucked in the pressure chambers from the feeding side. Once the application of the drive voltage is stopped, the deformed portion of the sheet type piezoelectric device and plate member returns to the original state and the volume of the pressure chamber returns to the original volume, so that the ink is sucked therein from the feeding side or ejected from the corresponding nozzle. In this way, these can function as an ink-jet recording head.

The electrodes may still also be disposed at the position that produces both the part where the direction of electric fields and the direction of polarization cross each other and the part where the former is identical with or reverse to the latter, i.e., using the unimorph type formation and the shearing mode type formation in combination. In this instance, the electrodes may be so disposed that they are formed on both sides of the sheet type piezoelectric device, and they are respectively formed at the positions corresponding to the pressure chambers and at the positions corresponding to the boundaries between adjoining pressure chambers on one side, and an electrode common to the all pressure chambers is formed on the other side. Under such formation, upon application of a drive voltage to such electrodes, the action of the both unimorph type and shearing mode type causes a change in volume of the pressure chamber, so that the ink is ejected from the corresponding nozzle or sucked in from the feeding side. Once the application of the drive voltage is stopped, the deformed portion of the sheet type piezoelectric device and plate member returns to the original state and the volume of the pressure chamber returns to the original volume, so that the ink is sucked in from the feeding side or ejected from the corresponding nozzle. In this way, these can function as an ink-jet recording head.

Utilizing the characteristic features of the present invention as described above, the present invention may also be constituted as described below. That is, two sets of the ink-jet recording head of the present invention as described above may be formed into one unit by joining them on the sides of their respective sheet-like cover members. For example, the two ink-jet recording heads may be joined in the manner the positions of the pressure chambers are alternately half-pitch shifted, to form one ink-jet recording head. When they are joined in this way, the arrangement density of nozzles can be doubled and also the resolution can be doubled. Such an ink-jet recording head, even though its pressure chambers are doubled, can achieve uniform lamination in respect to the all pressure chambers with ease and can attain uniform ejection performance in the all nozzles.

The two ink-jet recording heads may be joined using one sheet of the sheet-like cover member in common. This can save the sheet-like cover member.

The ink-jet recording head of the present invention can be formed, e.g., by the process as already described.

It is a process for forming the ink-jet recording head comprising a plate member in which a plurality of pressure chambers partitioned with sidewalls are formed in the form of grooves and one side of which is caused to vibrate by a piezoelectric device to thereby control the pressure of an ink held in the pressure chambers and eject the ink from nozzles communicating with the pressure chambers, wherein a sheet type piezoelectric device provided with electrodes and having been polarized is laminated to said plate member on its surface on the side opposite to the side on which the pressure chambers are formed in the form of grooves, the process comprising the steps of:

forming an electrode on the surface of an unbaked sheet type piezoelectric device;

joining the sheet type piezoelectric device to a plate member on its one side, made of a material having a nature similar or identical to the sheet type piezoelectric device, to form a laminate;

baking the laminate, and after the baking;

forming pressure chambers on the surface of the plate member side of the laminate;

covering the pressure chambers with a sheet-like cover member; and before or after the covering with the sheet-like cover member, subjecting the sheet type piezoelectric device to polarization.

Here, as the polarization, the sheet type piezoelectric device may be polarized, e.g., in its thickness direction. In this instance, the electrodes may be so formed that the direction of electric fields is identical with or reverse to the direction of polarization.. For example, the electrodes are formed on both sides of the sheet type piezoelectric device, and electrodes on the side the piezoelectric device is laminated to the plate member or on the side opposite thereto are provided for each pressure chamber. An electrode on the side opposite to the electrodes provided for each pressure chamber may be formed as an electrode common to the all pressure chambers.

The electrodes may also be so formed that the direction of electric fields and the direction of polarization cross each other. In this instance, the electrodes may be formed on one side or both sides of the sheet type piezoelectric device, and they are respectively provided at the positions corresponding to the pressure chambers and at the positions corresponding to the boundaries between adjoining pressure chambers.

The electrodes may still also be formed at the position that produces both the part where the direction of electric fields and the direction of polarization cross each other and the part where the former is identical with or reverse to the latter. In this instance, the electrodes may be formed on both sides of the sheet type piezoelectric device, and they are respectively formed at the positions corresponding to the pressure chambers and at the positions corresponding to the boundaries between adjoining pressure chambers on one side, and an electrode common to the all pressure chambers may be formed on the other side.

The pressure chambers can be formed on the surface of the plate member by shot blasting. The pressure chambers may also be formed by other cutting methods. The method such as shot blasting is preferred because it can form the pressure chambers without causing any strain in the plate member.

The ink-jet recording head constituted of the two ink-jet recording heads described above, formed into one unit by joining them on the sides of their respective sheet-like cover members can be produced, e.g., by a process as described below.

It is a process which comprises joining the laminate formed by the above ink-jet recording head formation process carried out up to the step before the joining of the sheet-like cover member, to the ink-jet recording head formed by the above ink-jet recording head formation process; the pressure chamber side of the former being joined to the sheet-like cover member side of the latter. They may be joined in the manner the positions of the pressure chambers are alternately half-pitch shifted.

BRIEF DESCRIPTION OF THE DRAWING

FIG. 2A is a vertical cross-sectional view showing a partially enlarged section of pressure chambers cut at right angles in their axial direction (along the line X—X in FIG. 1), and FIG. 2B illustrates how they operate when a drive voltage is applied.

FIG. 7A concerns the ink-jet recording head of Embodiment 2, and FIG. 7B, Embodiment 3.

PREFERRED EMBODIMENTS OF THE INVENTION

Embodiments of the present invention will be specifically described below with reference to the accompanying drawings.

Embodiment 1

Figure 1:
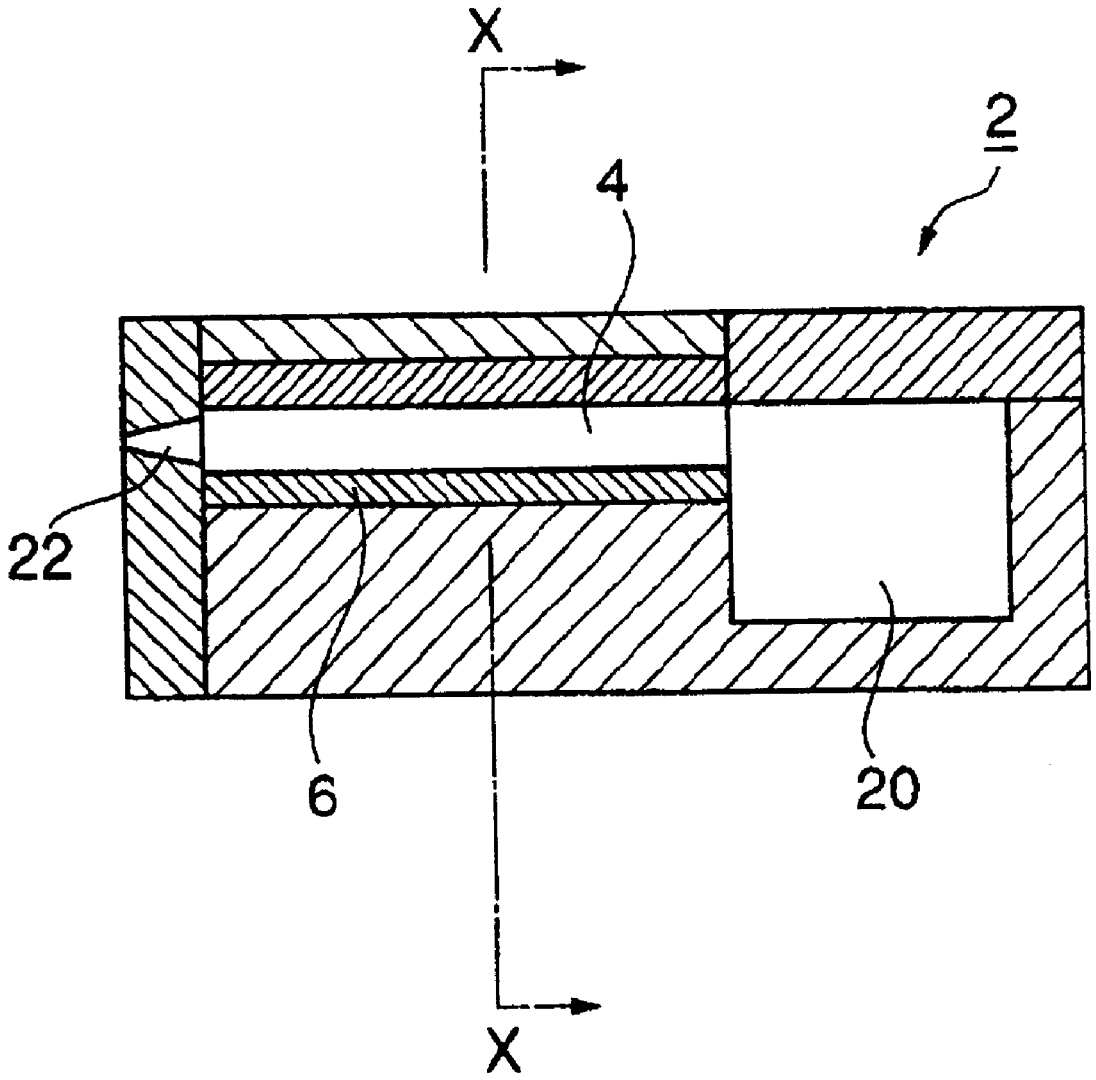
FIG. 1 is a vertical cross-sectional view of a pressure chamber cut in its axial direction, in the ink-jet recording head according to Embodiment 1.
Figure 2A:
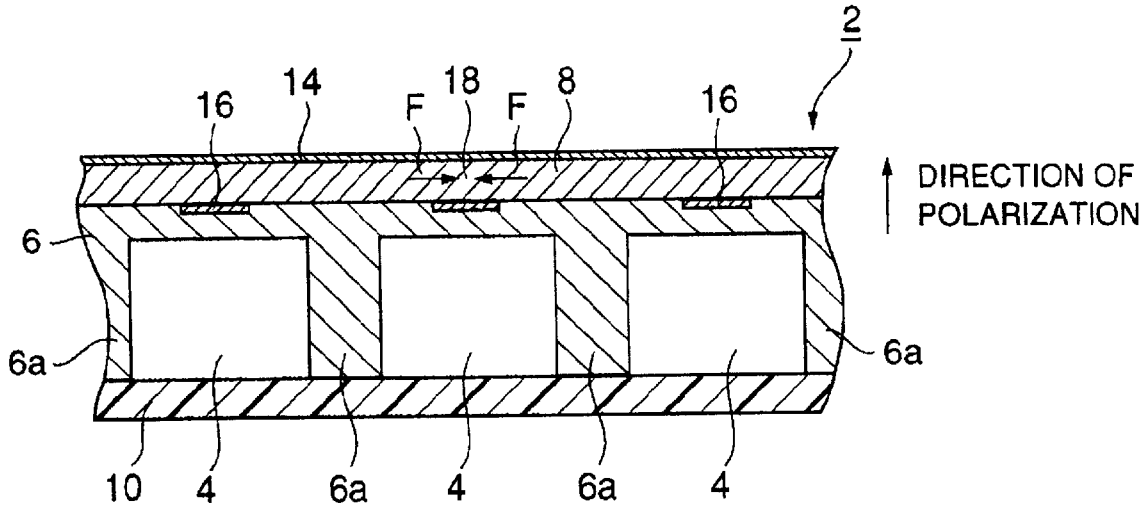
FIGS. 2A and 2B illustrate the construction and operation of an ink-jet recording head according to Embodiment 1 of the present invention.

FIG. 2A and FIG. 2 show the construction of an ink-jet recording head 2 to which some features of the present invention described above are applied. FIG. 1 is a vertical cross-sectional view of a pressure chamber 4 cut in its axial direction. FIG. 2A is a vertical cross-sectional view showing a partially enlarged section of pressure chambers 4 cut at right angles in their axial direction (along the line X—X in FIG. 1).

The pressure chambers 4 are partitioned with sidewalls 6*a* and are formed on one side of the plate member 6 in the form of grooves. To the surface of the plate member 6 on its side opposite to the open side of the pressure chambers 4, a sheet type piezoelectric device 8 is joined face to face on its one side. On the open side of the pressure chambers 4, the plate member 6 is covered with a sheet-like cover member 10 joined to the top edge faces of the sidewalls 6*a*.

On the surface of the sheet type piezoelectric device 8 on its side opposite to the plate member 6, a common electrode 14 is provided over substantially the whole surface. This common electrode 14 is used in common as a negative electrode corresponding to the all pressure chambers 4 formed in the plate member 6.

Between the sheet type piezoelectric device 8 and the plate member 6, positive independent electrodes 16 are also formed correspondingly to the individual pressure chambers 4.

The sheet type piezoelectric device 8 has been subjected to polarization in the thickness direction of the sheet type piezoelectric device 8 toward the side opposite to the pressure chambers 4 as shown by an arrow in the drawing. Hence, upon application of a drive voltage across the common electrode 14 and certain independent electrodes 16, the sheet type piezoelectric device 8 shrinks at its part 18 held between the common electrode 14 and the certain independent electrodes 16, in the direction as shown by arrows F in FIG. 2A, i.e., in the directions along the surface of the sheet type piezoelectric device 8.

Figure 2B:
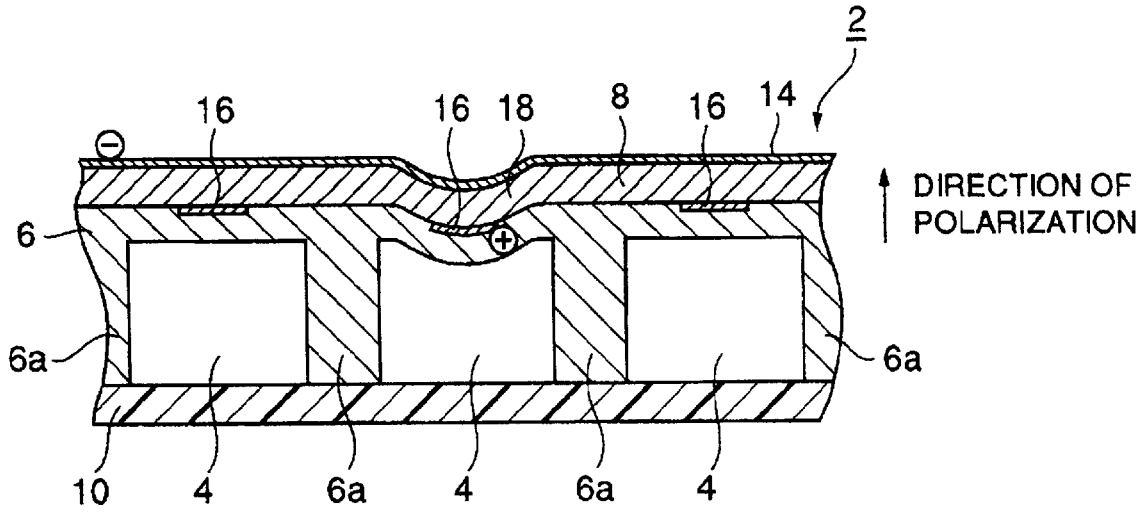

When the sheet type piezoelectric device 8 shrinks in this way at its part positioned at the middle of a certain pressure chamber 4, the plate member standing laminated thereto does not shrink, and hence the ink-jet recording head becomes convex on the side of the plate member 6 and becomes concave on the side of the sheet type piezoelectric device 8, where, as shown in FIG. 2B, the wall of the pressure chamber 4 projects at its part around the middle toward the inside of the pressure chamber 4. This causes a decrease in volume of the pressure chamber 4 to cause an increase in pressure of the ink, so that the ink is ejected outward from the corresponding nozzle 22.

Subsequently, once the application of the drive voltage is stopped, the state as shown in FIG. 2B returns to the state as shown in FIG. 2A and the volume of the pressure chamber 4 returns to the original volume to cause a decrease in pressure of the ink held in the pressure chamber 4, so that the ink is sucked into the pressure chamber 4 from an ink chamber 20.

This ink-jet recording head 2 is assembled through the steps as described below.

Figure 3A:
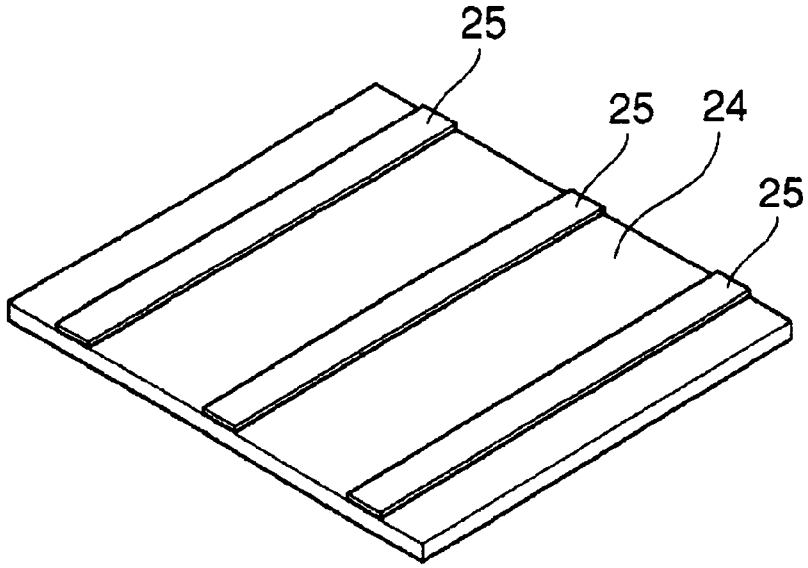
FIGS. 3A and 3B illustrate steps for producing the ink-jet recording head of Embodiment 1.

First, as shown in FIG. 3A, a conductive paste that forms the independent electrodes 16 is printed on one side of an unbaked PZT (lead titanate zirconate) type ceramic sheet 24 in a pattern 25 of the independnent electrodes 16.

Figure 3B:
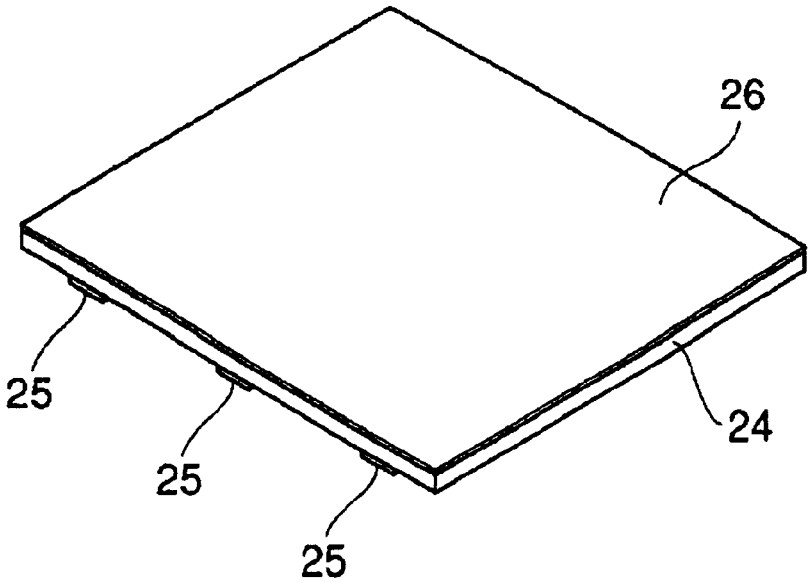

Next, as shown in FIG. 3B, a conductive paste that forms the common electrode 14 is printed on the side opposite to the side where the pattern 25 of the independent electrodes 16 have been formed, in a pattern 26 of the common electrode 14 that covers the whole surface of the PZT type ceramic sheet 24.

Figure 4A:
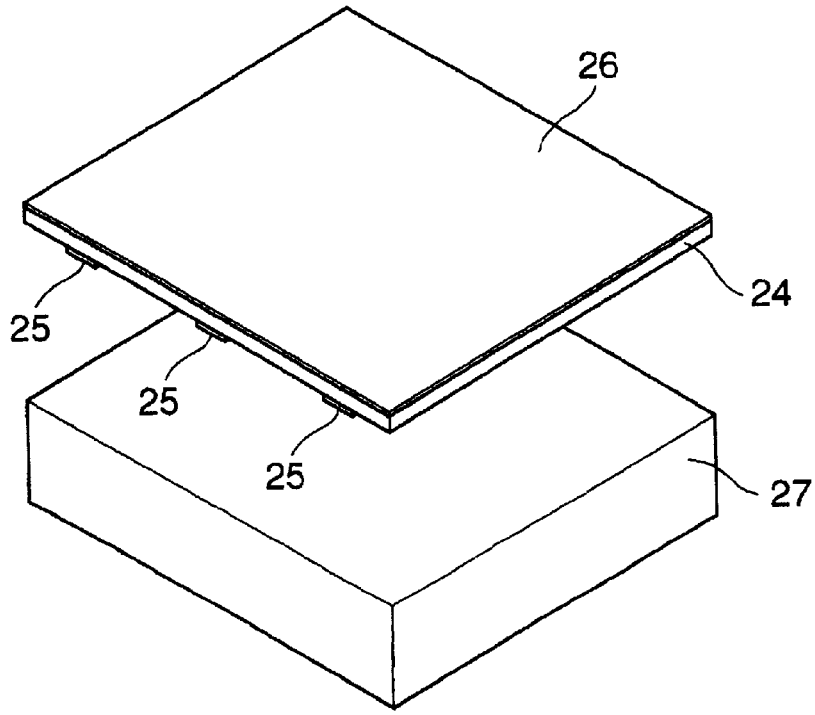
FIGS. 4A and 4B illustrate subsequent steps for producing the ink-jet recording head of Embodiment 1.

Next, as shown in FIG. 4A, an unbaked PZT type ceramic plate 27 having the same nature as the PZT type ceramic sheet 24 and a larger thickness than that is superposed to the unbaked PZT type ceramic sheet 24 on its surface on the side where the pattern 25 of the independent electrodes 16 has been formed. In the state they are superposed, they are vacuum-pressed to bring the unbaked PZT type ceramic sheet 24 and PZT type ceramic plate 27 into close contact.

Figure 4B:
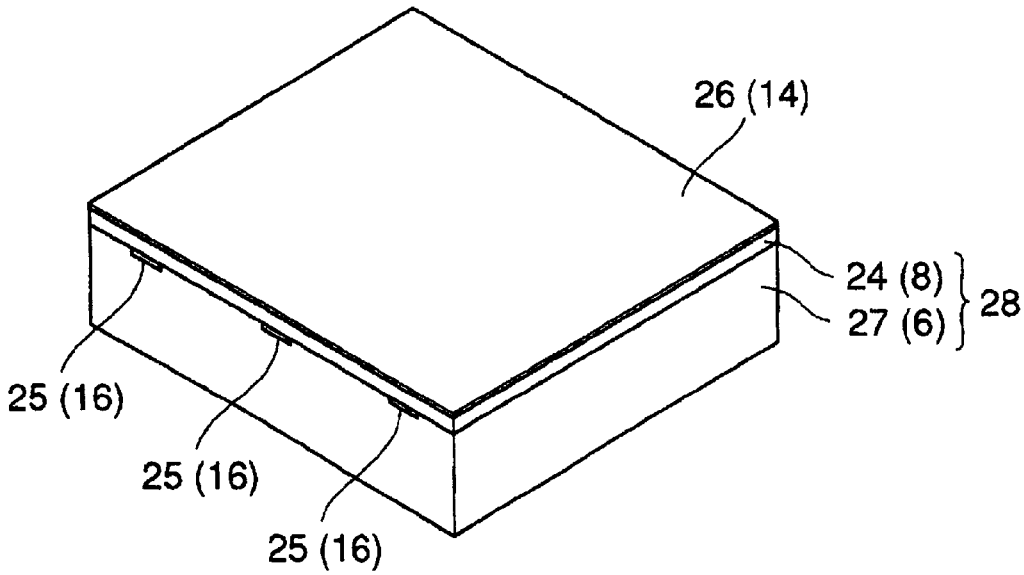
Figure 5A:
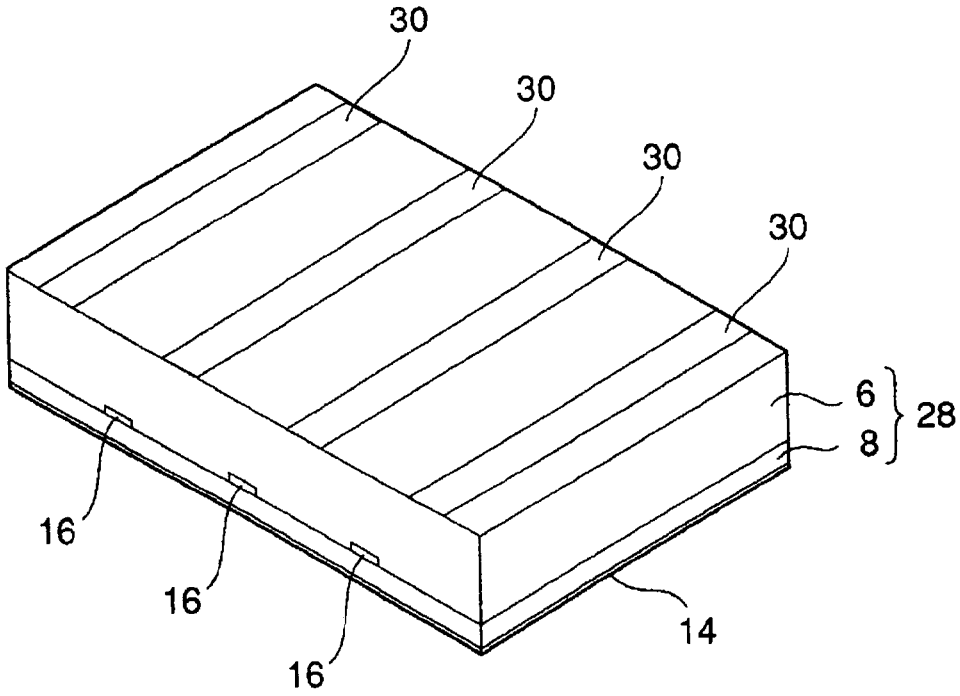
FIGS. 5A and 5B illustrate further steps for producing the ink-jet recording head of Embodiment 1.
Figure 5B:
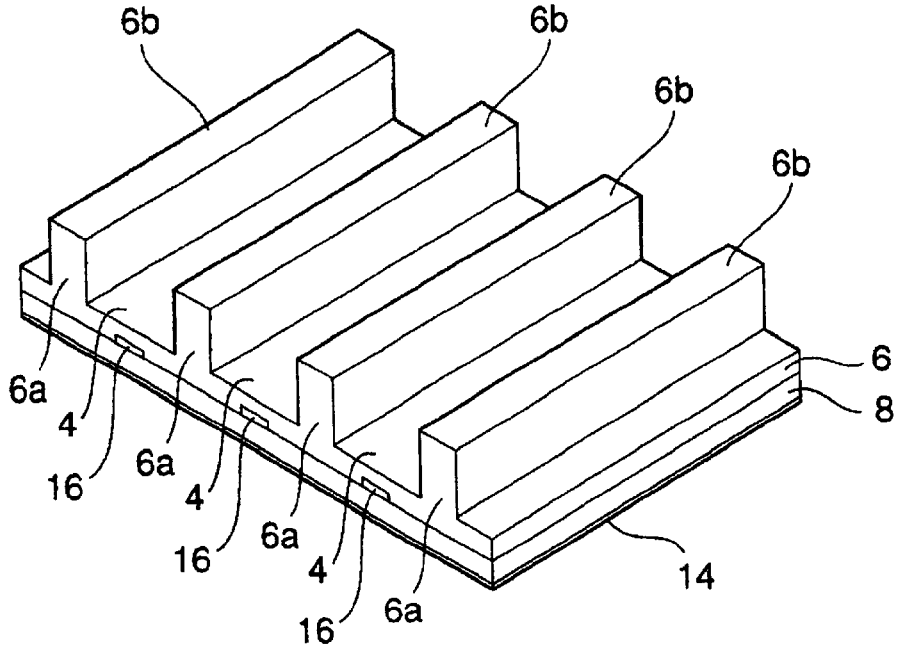

Next, these are baked to obtain a laminate as shown in FIG. 4B. Of this laminate 28, the external surface of the plate member 6 formed of the baked PZT type ceramic plate 27 is polished to make the surface smooth, and, as shown in FIG. 5A, resist masks 30 are formed at portions to be left as the sidewalls 6*a*. Then, as shown in FIG. 5B, pressure chambers 4 are formed in the form of grooves by shot blasting using ceramic powder, and the resist masks 30 at the top edge faces 6*b* of the sidewalls 6*a* are removed.

Figure 6A:
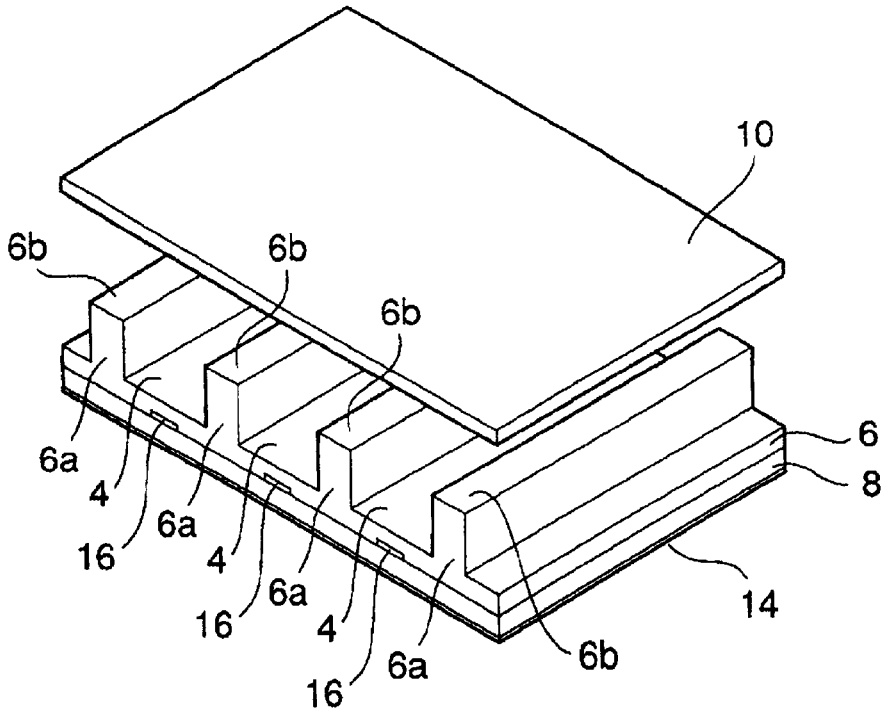
FIGS. 6A and 6B illustrate still further steps for producing the ink-jet recording head of Embodiment 1.
Figure 6B:
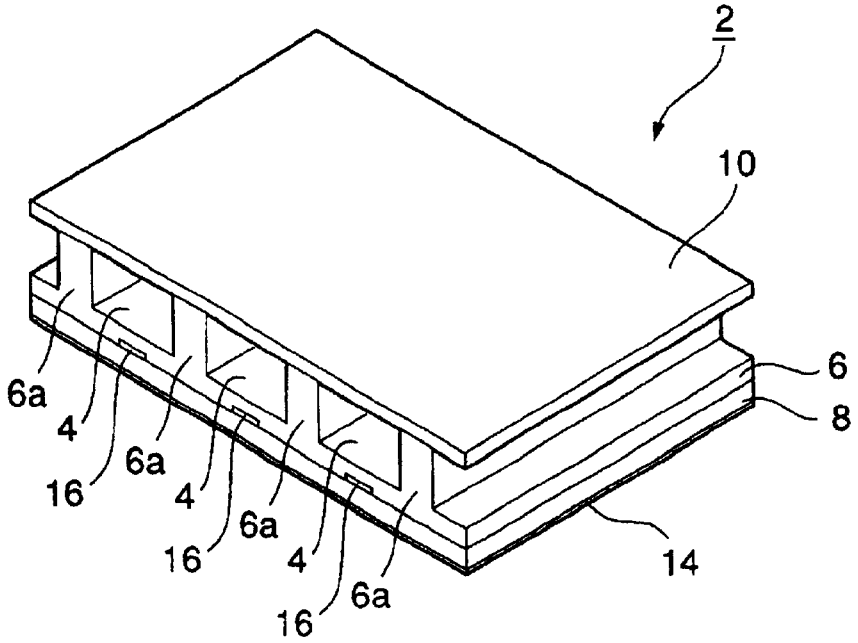

Next, as shown in FIG. 6A, the sheet-like cover member 10 is joined with an adhesive to the plate member 6 on the open side of its pressure chambers 4, i.e., at its top edge faces 6b of the sidewalls 6*a,* and other peripheral constituents are further assembled to make up the ink-jet recording head 2 as shown in FIGS. 6B and 1.

Then, utilizing the common electrode 14 and the independent electrodes 16 and setting the common electrode 14 side as the cathode and the independent electrodes 16 side as the anode, the sheet type piezoelectric device 8 is polarized as shown in FIGS. 2A and 2B, in the thickness direction and in the direction opposite to the pressure chambers 4.

Upon application of a drive voltage across the common electrode 14 and the independent electrodes 16, the ink-jet recording head according to the invention, thus produced, can function in the manner previously described.

In the ink-jet recording head 2 of the invention, the sheet type piezoelectric device 8 provided with the electrodes on its surfaces and also having been polarized stands laminated to the plate member 6 on its external surface on the side opposite to the one side on which the pressure chambers 4 are formed in the form of grooves. More specifically, the sheet type piezoelectric device 8 is laminated to the plate member 6 not on the open side of the pressure chambers 4 but on its external surface on the side opposite thereto. Accordingly, since the sheet type piezoelectric device 8 is not joined on the open side of the pressure chambers of the plate member, it follows that the device is not joined to the top edge faces 6*b* of the sidewalls 6*a* partitioning the pressure chambers 4 and is laminated to the external surface on the opposite-side continuous single surface.

Thus, for both the sheet type piezoelectric device 8 side and the plate member 6 side, the uniformity concerning flatness and joining may be achieved on the single surface, so that a lamination that is uniform over all of the pressure chambers 4 can be achieved with ease. At the same time, what directly changes the volume of the pressure chambers 4 is the plate member 6 itself, and, since the plate member 6 are integrally molded, there is no joints in it. Hence, there is no non-uniformity in the flatness or joints, and an ejection performance that is uniform over the all nozzles 22 can be attained.

In addition, since the sheet type piezoelectric device 8 is a single sheet that can correspond to all of the pressure chambers 4, the uniformity of performance can be more improved, and an ejection performance that is uniform over the all nozzles 22 can be attained.

The other side of the plate member 6, the open side of the pressure chambers 4, is covered with the sheet-like cover member 10. Even if the joints to this sheet-like cover member 10 have a little non-uniform flatness or joining, there is no effect on the ejection performance, because any deformation that may cause a change in volume of the pressure chambers 4 does not take place on the side of the sheet-like cover member 10.

The plate member 6 and the sheet type piezoelectric device 8 are made of material having the same nature, and hence the plate member 6 has high affinity for the sheet type piezoelectric device 8 that an ink-jet recording head 2 having a very high durability can be formed.

The polarization can be carried out by utilizing the common electrode 14 and the independent electrodes 16 as they are, and hence it is unnecessary to use any special polarization system, so that the ink-jet recording head can be produced efficiently and also at a low cost.

The invention is of the type wherein the direction of electric fields generated by the drive voltage is identical with the direction of polarization of the piezoelectric device, i.e., what is called the unimorph type, and is not the shearing mode type wherein the direction of electric fields generated by the drive voltage and the direction of polarization of the piezoelectric device cross each other at right angles. Hence, in particular, it is unnecessary to print the electrodes on the sheet type piezoelectric device 8 in a finely divided form. This is preferable in view of accuracy and also in view of production efficiency.

The pressure chambers 4 are formed on the surface of the plate member 6 by shot blasting, and hence the pressure chambers 4 can be formed with ease and without causing any strain in the plate member 6, thus more uniform ejection performance can be attained.

Embodiment 2

Figure 7A:
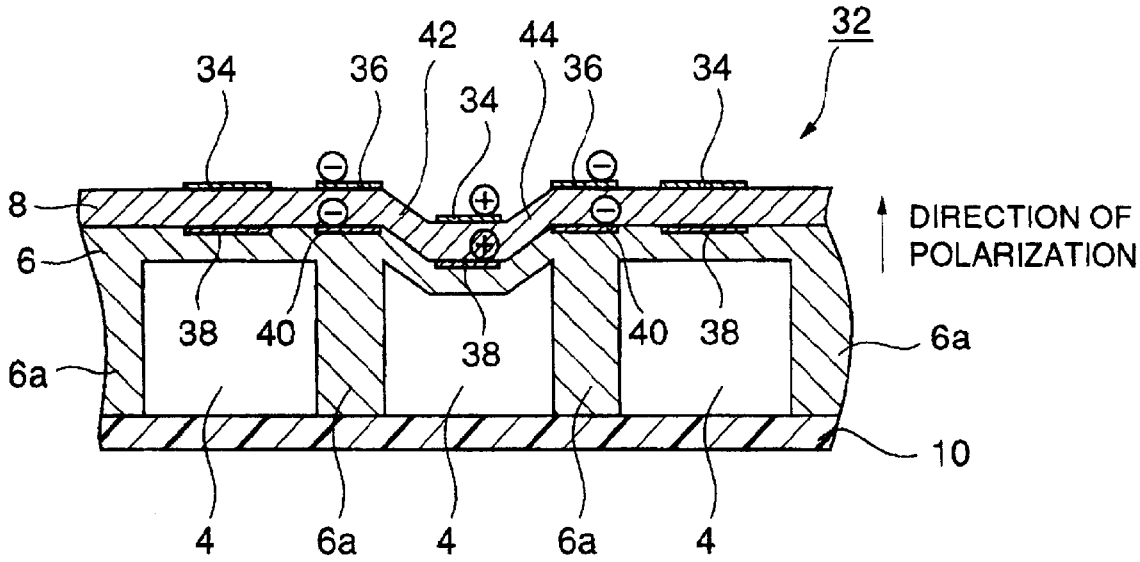
FIGS. 7A and 7B illustrate the construction and operation of ink-jet recording head according to Embodiments 2 and 3 of the present invention.

As shown in FIG. 7A, an ink-jet recording head 32 according to the invention is the same as that of FIGS. 2A–6B except that the disposition of electrodes 34, 36, 38 and 40 and the state of drive voltage application are different.

On the external surface of the sheet type piezoelectric device 8 on the side opposite to the plate member 6, independent electrodes 34 and 36 are respectively provided at the positions corresponding to the pressure chambers 4 and at the positions corresponding to the boundaries between adjoining pressure chambers 4. On the surface of the sheet type piezoelectric device 8 on its side joined to the plate member 6, independent electrodes 38 and 40 are also respectively provided at the positions corresponding to the independent electrodes 34 and 36 on the external surface side. Then, a positive drive voltage is applied to the independent electrodes 34 and 38 corresponding to the pressure chambers 4, and a negative drive voltage to the independent electrodes 36 and 40 between them.

In this formation, the electrodes are so disposed that the direction of electric fields and the direction of polarization cross each other (here, in the direction falling at right angles), i.e., stands in what is called the shearing mode type formation.

Upon application of a drive voltage, the sheet type piezoelectric device 8 undergoes thickness slippage to deform as shown in FIG. 7A, at its parts 42 and 44 held between the positive independent electrodes 34 and 38 and the negative independent electrodes 34 and 36, and sheet type piezoelectric device 8 comes into a state that is convex toward the pressure chamber 4 side at its part where the independent electrodes 36 and 40 are present. This causes a decrease in volume of the pressure chamber 4 to cause an increase in pressure of the ink, so that the ink is ejected outward from the corresponding nozzle 22.

Subsequently, once the application of the drive voltage is stopped, the volume of the pressure chamber 4 returns to the original volume from the state as shown in FIG. 7A, to cause a decrease in pressure of the ink held in the pressure chamber 4, so that the ink is sucked into the pressure chamber 4 from the ink chamber 20.

The invention brings about the same effects as shown in FIGS. 2A–6B except that the electrodes 34, 36, 38 and 40 must be printed in a large number on both sides of the sheet type piezoelectric device 8.

Embodiment 3

Figure 7B:
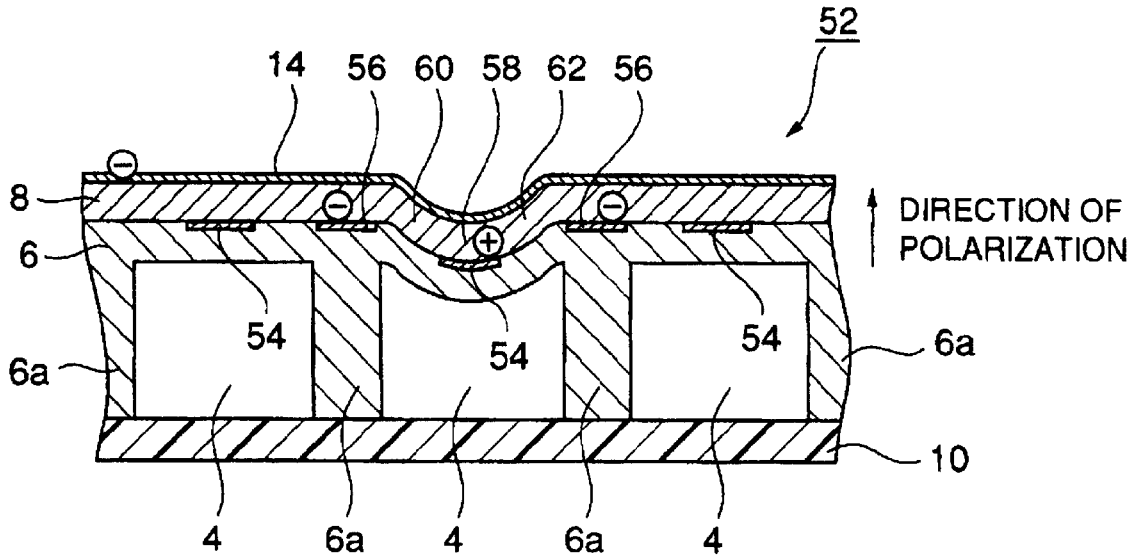

As shown in FIG. 7B, an ink-jet recording head 52 according to the present Embodiment 3 is the same as that of Embodiment 1 except that the disposition of electrodes 54 and 56 and the state of drive voltage application are different.

On the surface of the sheet type piezoelectric device 8 on its side joined to the plate member 6, independent electrodes 54 and 56 are respectively provided at the positions corresponding to the pressure chambers 4 and at the positions corresponding to the boundaries between adjoining pressure chambers 4. Then, a negative drive voltage is applied to the common electrode 14, a positive drive voltage to the independent electrodes 54 corresponding to the pressure chambers 4, and a negative drive voltage to the independent electrodes 56 between them.

In this formation, the electrodes are so disposed that the direction of electric fields is identical with or reverse to the direction of polarization and the direction of electric fields generated by the two independent electrodes 54 and 56 and the direction of polarization cross each other (here, in the direction falling at right angles). That is, these are formed of the unimorph type and the shearing mode type in combination.

Accordingly, at the part 58 held between the common electrode 14 and the independent electrode 54, the sheet type piezoelectric device 8 shrinks upon application of the drive voltage and the plate member 6 does not shrink. and hence the sheet type piezoelectric device 8 and the plate member 6 become convex toward the pressure chamber 4. Also, at the parts 60 and 62 between the two independent electrodes 54 and 56, the sheet type piezoelectric device 8 undergoes thickness slippage to deform to come into a state that is convex toward the pressure chamber 4 side at its part where the independent electrode 54 is present.

In this way, the sheet type piezoelectric device 8 and the plate member 6 become convex toward the pressure chamber 4 by the cooperational action of the unimorph type and shearing mode type. This causes a decrease in volume of the pressure chamber 4 to cause an increase in pressure of the ink, so that the ink is ejected outward from the corresponding nozzle 22. Once the application of the drive voltage is stopped, the volume of the pressure chamber 4 returns to the original volume from the state as shown in FIG. 7B, to cause a decrease in pressure of the ink held in the pressure chamber 4, so that the ink is sucked into the pressure chamber 4 from the ink chamber 20.

The invention makes it necessary to print the electrodes 54 and 56, 58 in a large number on the surface of the sheet type piezoelectric device 8 on the side of the plate member 6, but the ejection quantity of ink can be made much larger than the ink-jet recording head of FIGS. 2A–6B. because of the cooperational action of the unimorph type and shearing mode type.

Embodiment 4

Figure 8:
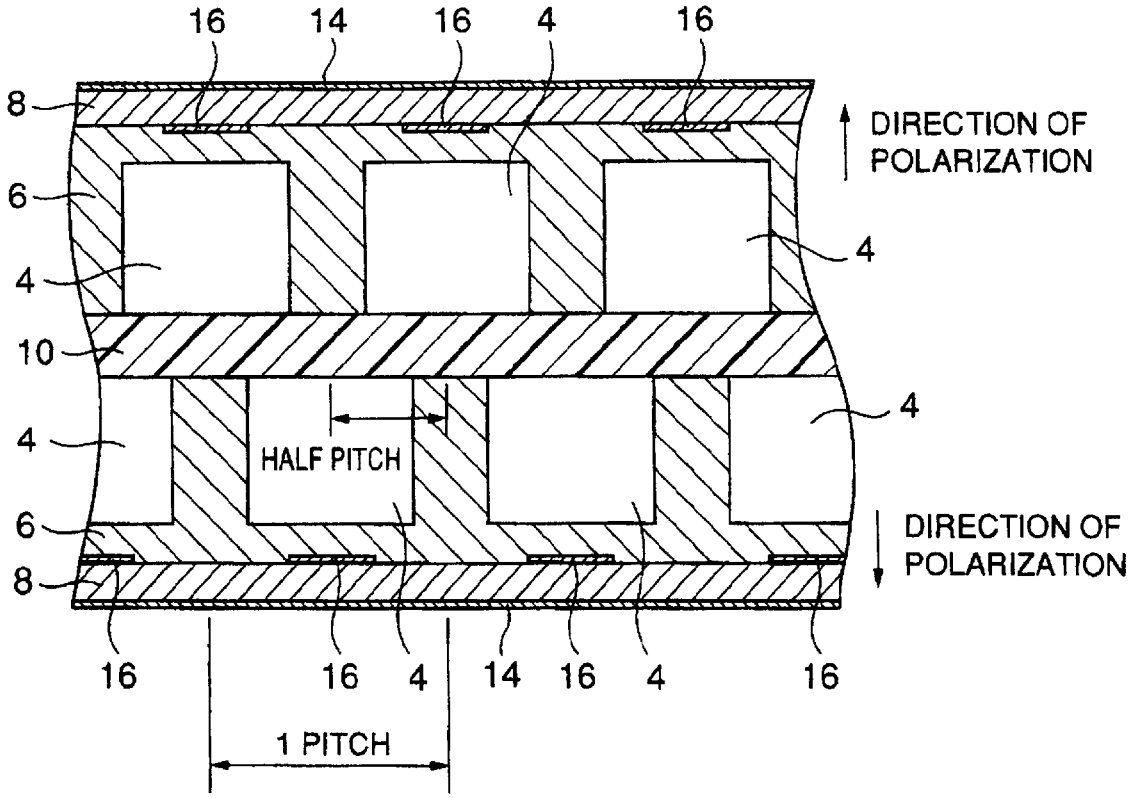
FIG. 8 illustrates the construction of an ink-jet recording head according to Embodiment 4.

As shown in FIG. 8, an ink-jet recording head 72 according to the present Embodiment 4 corresponds to the construction in which the two ink-jet recording heads according to Embodiment 1 are joined in the manner the positions of the pressure chambers are alternately half-pitch shifted.

Figure 9:
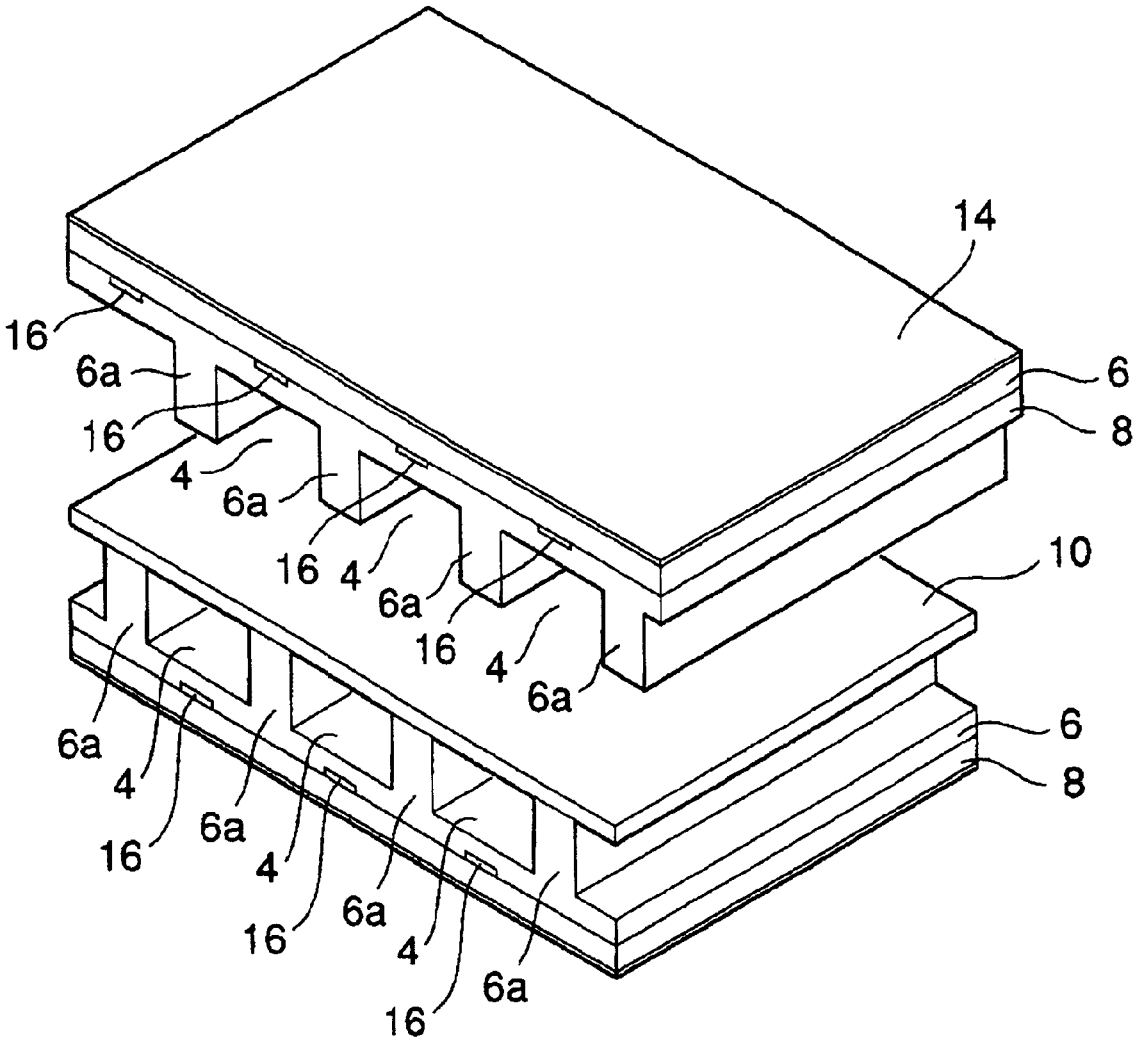
FIG. 9 illustrates a step for producing the ink-jet recording head of Embodiment 4.
Figure 10A:
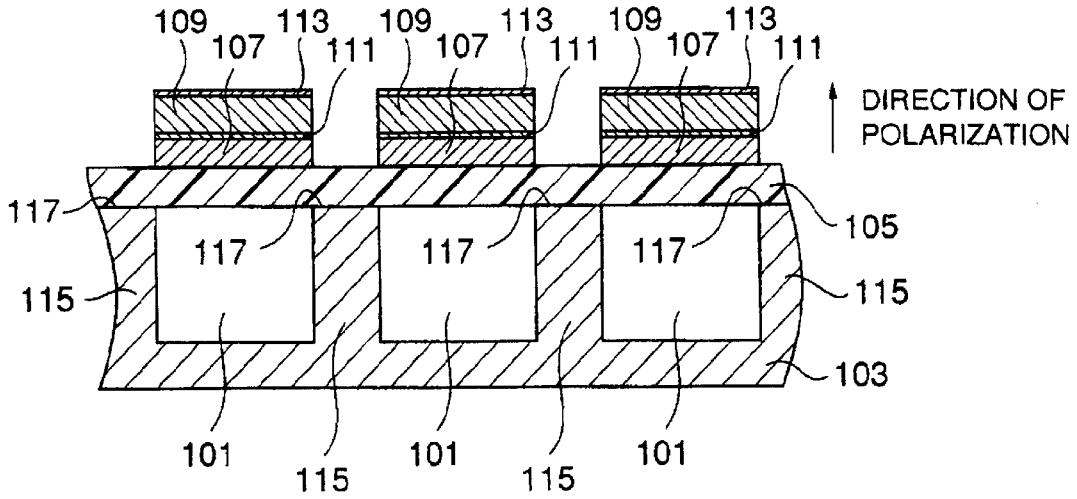
FIGS. 10A and 10B illustrate the construction of two ink-jet recording heads according to the prior art.
Figure 10B:
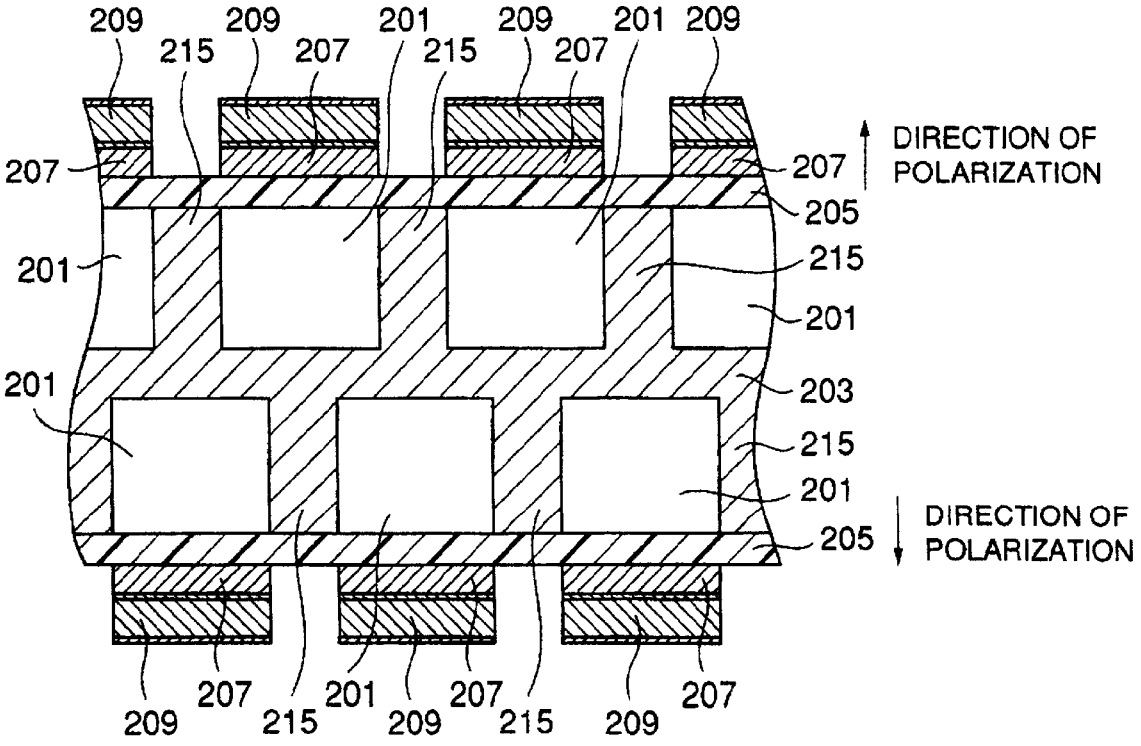

More specifically, as shown in FIG. 9, the ink-jet recording head 72 is formed in the following way: To the structure formed up to the one shown in FIG. 6, the unfinished structure as shown in FIG. 5B, formed before the sheet-like cover member 10 is joined, is joined at its top edge faces 6*b* of the sidewalls 6*a* of the plate member 6 in the manner the positions of the pressure chambers are alternately half-pitch shifted.

When the ink-jet recording head is formed in this way, the arrangement density of the nozzles 22 can be doubled on the other side of the sheet-like cover member 10, and the density of nozzles can be made higher with ease, without causing the problem of flatness for each sidewall or non-uniformity in joining.

In the above ink-jet recording heads of FIGS. 2A–6B, 7B and 8, the direction of electric fields is identical with the direction of polarization. Alternatively, the former may be reverse to the latter, where the sheet type piezoelectric device 8 extends and the sheet type piezoelectric device 8 and plate member 6 partly become convex outward, so that the ink is sucked into the pressure chamber 4 from the ink chamber 20, and once the application of the drive voltage is stopped, the pressure chamber returns to the original state, so that the ink is ejected outward. The ink-jet recording head functions in this way.

In the ink-jet recording head of FIG. 7A, the direction of polarization may also be reversed so that the sheet type piezoelectric device 8 and plate member 6 may partly become convex upon application of the drive voltage.

In ink-jet recording heads of FIGS. 2A–6B, 7B,and 8, the common electrode 14 is formed on the sheet type piezoelectric device 8 on its side opposite to the plate member 6. Alternatively, the common electrode 14 may be formed on the side of the plate member 6 and the independent electrodes 16, 54 and 56 may be formed on the side opposite to the plate member 6.

In the ink-jet recording head of FIG. 8, the ink-jet recording head 2 of FIGS. 2A–6B and the unfinished structure formed in the course of the formation process are brought into one unit. Alternatively, the ink-jet recording head 32 or 52 of FIGS. 7A or 7B and the unfinished structure formed in the course of the formation process may be brought into one unit. Also, any of finished ink-jet recording heads 2, 32 and 52 may be joined to each other at the sheet-like cover members 10 so as to be brought into one unit.

What is claimed is:

1. A process for forming an ink-jet recording head including a plate member having a first side and a second flat side opposite the first side, the second flat side caused to vibrate by a piezoelectric device to control the pressure of ink in a plurality of pressure chambers and to eject the ink from nozzles communicating with the pressure chambers, wherein the piezoelectric device includes a polarized sheet type piezoelectric device, having substantially a same width and length as the second flat side of the plate member, and electrodes disposed on the sheet type piezoelectric device, the process comprising:

forming the electrodes on both surfaces of the sheet type piezoelectric device;

joining the piezoelectric device to the plate member on the second flat side, the plate member made of a material having a nature similar or identical to the sheet type piezoelectric device, to form a laminate;

baking the laminate;

forming the plurality of pressure chambers in the plate member, in a form of grooves partitioned with sidewalls, on the first side of the plate member the plurality of pressure chambers being formed after baking the laminate;

covering the pressure chambers with a sheet-like cover member; and polarizing the sheet type piezoelectric device.

2. The process for forming an ink-jet recording head according to claim 1, wherein the sheet type piezoelectric device is polarized in a thickness direction of the sheet type piezoelectric device.

3. The process for forming an ink-jet recording head according to claim 2, wherein the electrodes are so disposed that a direction of electric fields between the electrodes is about the same as or opposite to the direction of polarization of the sheet type piezoelectric device.

4. The process for forming an ink-jet recording head according to claim 3, wherein the electrodes are formed on both sides of the sheet type piezoelectric device, and the electrodes on at least one side of the sheet type piezoelectric device are provided for each pressure chamber.

5. The process for forming an ink-jet recording head according to claim 4, wherein a single electrode, having substantially a same width and length as the sheet type piezoelectric device, opposite to the electrodes on the at least one side of the sheet type piezoelectric device provided for each pressure chamber, forms one electrode pole of the piezoelectric device.

6. The process for forming an ink-jet recording head according to claim 2, wherein the electrodes are so disposed that a direction of electric fields between the electrodes and a direction of polarization of the sheet type piezoelectric device cross each other.

7. The process for forming an ink-jet recording head according to claim 6, wherein the electrodes are formed on at least one side of the sheet type piezoelectric device, and are respectively provided at positions corresponding to the pressure chambers and at positions corresponding to boundaries between adjoining pressure chambers.

8. The process for forming an ink-jet recording head according to claim 2, wherein the electrodes are so disposed that direction components of electric fields between the electrodes and the direction of polarization of the sheet type piezoelectric device, in part, cross each other and are in the same or opposite direction of that of the direction of polarization.

9. The process for forming an ink-jet recording head according to claim 8, wherein the electrodes are formed on both sides of the sheet type piezoelectric device, and electrodes on one side of the sheet type piezoelectric device are located at positions corresponding to each pressure chamber and each boundary between adjoining pressure chambers, and a single electrode, having substantially a same width and length as the sheet type piezoelectric device, is formed on a side opposite to the one side of the piezoelectric device to form one electrode pole of the piezoelectric device.

10. The process for forming an ink-jet recording head according to claim 1, wherein the pressure chambers are formed on the first side of the plate member by shot blasting.

11. A process for forming an ink-jet recording head according to claim 1, the process comprising:

joining the laminate formed by the ink-jet recording head formation process according to claim 1, without covering the pressure chambers with a sheet-like cover member; and joining the first side of the plate member of the laminate so formed to the sheet-like cover member of another ink-jet recording head formed according to claim 1.

12. The process for forming an ink-jet recording head according to claim 11, wherein the laminate and the another ink-jet recording head are joined so that positions of their respective pressure chambers are alternately shifted one-half pitch along the longitudinal axes of both the laminate and the another ink-jet recording head.

13. An ink-jet recording head, comprising:

a plate member having a first side and a second flat side opposite the first side;

a plurality of pressure chambers in a form of grooves partitioned with sidewalls formed in the first side, the second flat side caused to vibrate by a piezoelectric device to control the pressure of ink in the pressure chambers and to eject the ink from nozzles communicating with the pressure chambers, wherein the piezoelectric device includes a polarized sheet type piezoelectric device, having substantially a same width and length as the second flat side of the plate member, and electrodes disposed on the sheet type piezoelectric device, and is laminated to the plate member on the second flat side, the plate member made of a material having a nature similar or identical to the sheet type piezoelectric device, to form a laminate.

14. The ink-jet recording head according to claim 13, wherein the first side of the plate member is covered with a sheet-like cover member.

15. The ink-jet recording head according to claim 13, wherein the sheet type piezoelectric device is polarized in a thickness direction of the sheet type piezoelectric device.

16. The ink-jet recording head according to claim 15, wherein the electrodes are so disposed that a direction of electric fields between the electrodes is about the same as or opposite to the direction of polarization of the sheet type piezoelectric device.

17. The inkjet recording head according to claim 16, wherein the electrodes are formed on both sides of the sheet type piezoelectric device, and the electrodes on at least one side of the sheet type piezoelectric device are provided for each pressure chamber.

18. The ink-jet recording head according to claim 17, wherein a single electrode, having substantially a same width and length as the sheet type piezoelectric device, opposite to the electrodes on the at least one side of the sheet type piezoelectric device provided for each pressure chamber, forms one electrode pole of the piezoelectric device.

19. The ink-jet recording head according to claim 15, wherein the electrodes are so disposed that a direction of electric fields between the electrodes and a direction of polarization of the sheet type piezoelectric device cross each other.

20. The ink-jet recording head according to claim 19, wherein the electrodes are formed on at least one side of the sheet type piezoelectric device, and are respectively provided at positions corresponding to the pressure chambers and at positions corresponding to boundaries between adjoining pressure chambers.

21. The ink-jet recording head according to claim 15, wherein the electrodes are so disposed that direction components of electric fields between the electrodes and the direction of polarization of the sheet type piezoelectric device, in part, cross each other and are in the same or opposite direction to that of the direction of polarization.

22. The ink-jet recording head according to claim 21, wherein the electrodes are disposed on both sides of the sheet type piezoelectric device, and electrodes on one side of the sheet type piezoelectric device are disposed at positions corresponding to each pressure chamber and each boundary between adjoining pressure chambers, and a single electrode, having substantially a same width and length as the sheet type piezoelectric device, is formed on a side opposite to the one side of the sheet type piezoelectric device, to form one electrode pole of the piezoelectric device.

23. An ink-jet recording head comprising at least two ink-jet recording heads according to claim 13, that are joined into an integral unit by joining the sheet-like cover members of the at least two ink-jet recording heads.

24. The ink-jet recording head according to claim 23, wherein at least two of the ink-jet recording heads are joined in a manner so positions of the pressure chambers are alternately shifted one-half pitch along the longitudinal axes of the ink-jet recording heads.

25. The ink-jet recording head according to claim 23, wherein at least two of the ink-jet recording heads are joined by using one sheet-like cover member in common.

* * * * *